US009011186B2

(12) United States Patent
Wirth et al.

(10) Patent No.: US 9,011,186 B2
(45) Date of Patent: Apr. 21, 2015

(54) ELECTRICAL CONNECTION ELEMENT

(71) Applicant: Delphi Technologies, Inc., Troy, MI (US)

(72) Inventors: Karl Wirth, Pulheim (DE); Oliver Gugutzer, Neumarkt (DE); Juergen Lausch, Neumarkt (DE)

(73) Assignee: Delphi Technologies, Inc., Troy, MI (US)

( * ) Notice: Subject to any disclaimer, the term of this patent is extended or adjusted under 35 U.S.C. 154(b) by 67 days.

(21) Appl. No.: 13/926,463

(22) Filed: Jun. 25, 2013

(65) Prior Publication Data

US 2014/0030934 A1 Jan. 30, 2014

(30) Foreign Application Priority Data

Jul. 24, 2012 (EP) ..... 12177673

(51) Int. Cl.
*H01R 11/22* (2006.01)
*H01R 13/11* (2006.01)
*H01R 13/18* (2006.01)

(52) U.S. Cl.
CPC ..... *H01R 13/11* (2013.01); *H01R 13/112* (2013.01); *H01R 13/18* (2013.01); *H01R 2201/26* (2013.01)

(58) Field of Classification Search
USPC ..... 439/839, 842, 843, 845, 847, 852, 856
See application file for complete search history.

(56) References Cited

U.S. PATENT DOCUMENTS

| | | | | |
|---|---|---|---|---|
| 5,362,262 | A * | 11/1994 | Hotea | 439/839 |
| 6,290,553 | B1 * | 9/2001 | Sato et al. | 439/843 |
| 6,685,512 | B2 * | 2/2004 | Ooya | 439/630 |
| 6,749,470 | B2 * | 6/2004 | Dangelmaier | 439/857 |
| 7,278,891 | B2 * | 10/2007 | Cvasa et al. | 439/852 |
| 2002/0076998 | A1 * | 6/2002 | Feye-Homann | 439/839 |
| 2006/0252294 | A1 * | 11/2006 | Cvasa et al. | 439/252 |
| 2008/0090473 | A1 * | 4/2008 | Katano | 439/816 |
| 2011/0076901 | A1 * | 3/2011 | Glick et al. | 439/839 |
| 2014/0030934 | A1 * | 1/2014 | Wirth et al. | 439/816 |

FOREIGN PATENT DOCUMENTS

FR 2844105 A1 * 3/2004 ..... H01R 13/112

* cited by examiner

*Primary Examiner* — James Harvey
(74) *Attorney, Agent, or Firm* — Robert J. Myers

(57) ABSTRACT

The invention relates to an electrical terminal element comprising a base element with at least one terminal section and at least one socket section which has at least one contact arm for contacting a plug-in contact which can be introduced into the socket section. In a contact region in which contacting of the inserted plug-in contact takes place, the contact arm is divided into at least two partial contacts. Also, the electrical terminal element comprises an additional spring which surrounds the base element in the region of the socket section and which has at least one additional spring arm which at least in the contact region cooperates with the contact arm, so that the latter can be deflected against a return force of the additional spring arm.

11 Claims, 2 Drawing Sheets

ELECTRICAL CONNECTION ELEMENT

CROSS-REFERENCE TO RELATED APPLICATION

This application claims the benefit under 35 U.S.C. §119 (a) of European Patent Application EP 12177673.6, filed on Jul. 24, 2012, the entire disclosure of which is hereby incorporated by reference.

TECHNICAL FIELD OF THE INVENTION

The invention generally relates to an electrical terminal element having a base element with a terminal section and a socket section which a contact arm for contacting a plug-in contact which can be introduced into the socket section.

BACKGROUND OF THE INVENTION

Electrical terminal elements of this kind serve to provide a releasable electrical connection between the plug-in contact and the terminal element, and are used in motor vehicles, for example. In this case the plug-in connections must be able to withstand strong vibrations as well as extreme temperatures and at the same time conduct high currents. Throughout the life of the terminal element, a reliable electrical connection must also be ensured between the terminal element and the plug-in contact.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with a first embodiment of this invention, an electrical terminal element is provided. The electrical terminal element includes a base element with at least one terminal section and at least one socket section which has at least one contact arm for contacting a plug-in contact which can be introduced into the at least one socket section. The at least one contact arm is divided into at least two partial contacts in a contact region in which contacting of the inserted plug-in contact takes place. The electrical terminal element further includes an additional spring which surrounds the base element in a region of the at least one socket section and which has at least one additional spring arm which cooperates with the at least one contact arm at least in the contact region, so that the latter can be deflected against a return force of the at least one additional spring arm.

In accordance with a second embodiment of this invention, the at least one additional spring arm is bent inwardly in a region of an insertion opening for the plug-in contact.

In accordance with a third embodiment of this invention, the at least one additional spring arm comprises at least two support tongues which each cooperate with one of the at least two partial contacts.

In accordance with a fourth embodiment of this invention, the at least two support tongues extend in a direction of the insertion opening for the plug-in contact.

In accordance with a fifth embodiment of this invention, the at least two support tongues protrude from support sections of the at least one additional spring arm.

In accordance with a sixth embodiment of this invention, the support sections are connected to each other by a web which is tapered relative to the support sections.

In accordance with a seventh embodiment of this invention, the support sections are connected by a connecting section to an outer wall of the additional spring.

In accordance with an eighth embodiment of this invention, the base element has two mutually opposed contact arms and the additional spring has two additional spring arms which each cooperate with at least one contact arm.

In accordance with a ninth embodiment of this invention, the additional spring has at least one inwardly bent guide lug which on the inside overlaps an end region of at least one contact arm in the region of the insertion opening for the plug-in contact.

In accordance with a tenth embodiment of this invention, the guide lug biases the at least one contact arm outwardly.

In accordance with an eleventh embodiment of this invention, the guide lug protrudes from the outer wall of the additional spring, from which the at least one additional spring arm also protrudes.

In accordance with a twelfth embodiment of this invention, the additional spring comprises at least one outwardly extending primary latch spring, which is arranged in a recess in the outer wall of the additional spring.

In accordance with a thirteenth embodiment of this invention, the base element and the additional spring form separate components, the additional spring being connected to the base element in form-locking relationship.

In accordance with a fourteenth embodiment of this invention, the base element is designed as a stamped and bent part and/or the additional spring is designed as a stamped and bent part and is substantially cuboid.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
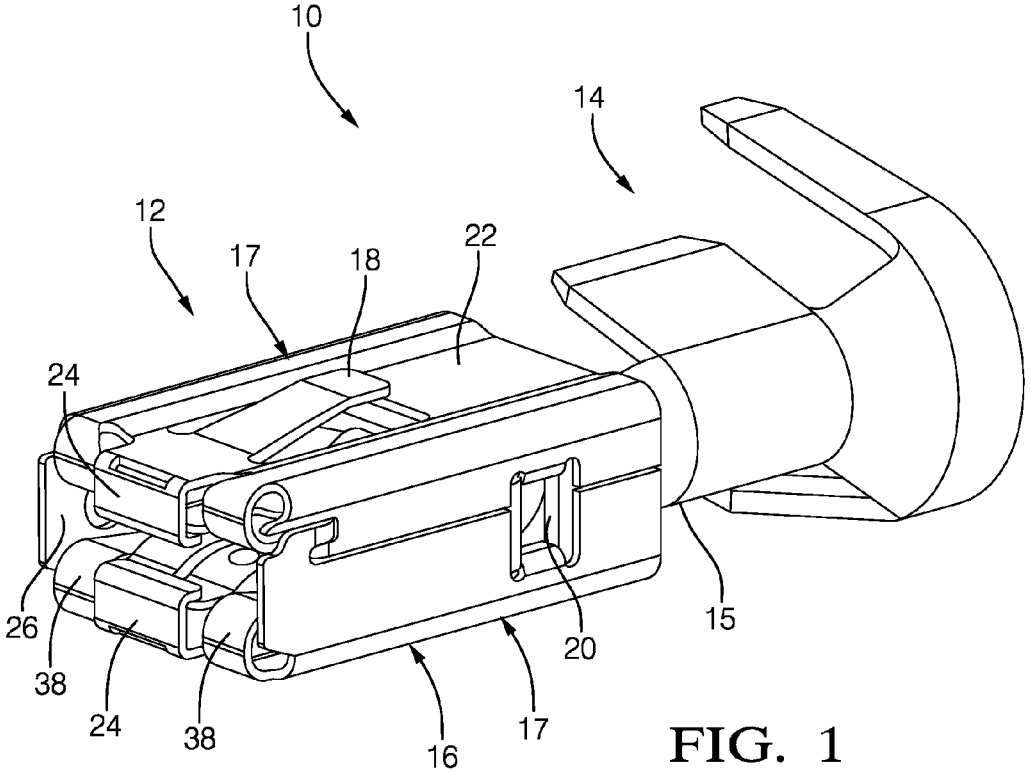
FIG. 1 is a perspective view of an electrical terminal element in accordance with one embodiment.

An electrical terminal element includes a base element having at least one terminal section and at least one socket section. In this case the terminal section is provided to connect the terminal element to an electrical cable, while the socket section serves to receive a plug-in contact and to contact it by means of a contact arm, in order thus to make an electrical connection between the plug-in contact and the electrical cable.

In a contact region provided for contacting of the inserted plug-in contact, the contact arm is divided into at least two partial contacts. The reliability of contacting between plug-in contact and contact arm is in this way increased, because usually a single partial contact would be sufficient for contacting, but according to the invention to a certain extent redundant contacting is performed.

In the region of the socket section, the base element is surrounded by an additional spring which has at least one additional spring arm which cooperates with the contact arm at least in the region of the contact surface, so that the contact arm can be deflected against a return force of the additional spring arm. The additional spring arm therefore to a certain extent provides spring support for the contact arm. For this purpose the additional spring can be made of for example special steel, preferably spring steel.

According to the invention, the additional spring arm forms part of the additional spring, so that it can be made with minimum expenditure on materials. Advantageously, the additional spring arm is elastically movable over a wide range without being plastically deformed.

The quality and reliability of electrical contact between contact arm and plug-in contact is greatly increased by the additional spring arm and inherent elasticity of the contact arm, which exists in addition if occasion arises. In particular, the risk of relaxation of the normal force of contact, that is, the contact force when the plug-in contact is introduced, is greatly minimized by the additional spring. Therefore even in case of high vibrational stresses and/or high temperature fluctuations, reliable contacting is guaranteed over long periods.

Furthermore, due to the supporting effect of the additional spring arm, the contact arm can be made of a cheaper material, for example a wrought copper alloy with less strength, as a result of which the terminal element as a whole can be made with less expenditure.

Preferably, each additional spring arm is bent inwardly in the region of an insertion opening for the plug-in contact. The additional spring arm therefore contributes to restricting the insertion opening, which is located in the region of a front end of the socket section and so lies opposite the terminal section, which is located in the rear region of the terminal element.

Preferably, each additional spring arm comprises at least two support tongues which each cooperate with one of the partial contacts. In the process, if the plug-in contact is not inserted, the support tongues can touch the partial contacts or alternatively be a short distance from the partial contacts. If the partial contacts are forced outwardly during the introduction of a plug-in contact, as a result the support tongues and hence the additional spring arm are also deflected, to generate a return force which forces the partial contacts against the plug-in contact. If the partial contacts and the support tongues are arranged at a distance from each other, a return force is generated by the support tongues only when the partial contacts have been moved so far outwardly that they touch the support tongues. Since each partial contact has its own support tongue, the partial contacts can in at least one region be moved independently of each other. Support is also provided by the support tongues in each case independently. The reliability of contact is still further increased by this redundant construction. Also, for example asymmetrically shaped plug-in contacts can be contacted with the terminal element, as the partial contacts and the support tongues which support them can be deflected to different extents and so can adapt to the shape of an asymmetrical plug-in contact.

According to one embodiment, the support tongues extend in the direction of the insertion opening for the plug-in contact. The support tongues, in other words, therefore extend in the opposite direction to the additional spring arm, which extends forwardly and therefore, starting from the insertion opening, rearwardly.

Preferably, the support tongues protrude from support sections of the additional spring arm. In this case the support sections can have a larger surface area than the support tongues, to increase the mechanical stability of the additional spring arm.

Furthermore, the support sections can be connected to each other by a web which is advantageously tapered relative to the support sections, in order thus to achieve partial mechanical uncoupling of the support sections. Hence the support sections can be moved towards each other within certain limits. The forces acting on a support section from a support tongue are therefore only partially transmitted to the other support section. Consequently, the partial contacts can be moved partially independently of each other by the respectively associated support tongues and support sections, in order, as already mentioned, to increase the reliability of contacting of the terminal element.

According to a further embodiment, the support sections are in each case connected by a connecting section to an outer wall of the additional spring. The connecting sections can protrude from an outer wall of the additional arm in the region of the insertion opening and be bent inwardly.

Preferably, the base element has two mutually opposed contact arms, and the additional spring has two mutually opposed additional spring arms which each cooperate with one of the contact arms. A plug-in contact can therefore be introduced between inversely symmetrically opposed contact arms and be contacted on both sides by the contact arms. In this case the contact arms are each supported by an additional spring arm. Due to double contacting on two sides with a total of four partial contacts, firstly a contact surface area between the contact arms and the plug-in contact is doubled, and secondly the reliability of contact is further increased.

Preferably, the additional spring has, in the region of the insertion opening for the plug-in contact, at least one inwardly bent guide lug which, on the inside, overlaps an end region of one of the contact arms. The guide lug therefore performs a triple function: firstly, it defines the insertion opening for the plug-in contact, so that for example incongruously shaped or excessively large plug-in contacts cannot be introduced into the insertion opening. Secondly, due to receiving a contact arm on the inside, the guide lug provides protection against insertion of the plug-in contact behind the contact arm. The plug-in contact can therefore be prevented from being inserted between the contact arm and an inner wall of the additional spring. Thirdly, the plug-in contact is guided by the guide lug into the insertion opening, which makes it easier to insert the plug-in contact. The size of a pin of the plug-in contact can vary in this case, preferred pin dimensions being in the range from 0.8 millimeters (mm)×4.8 mm to 0.8 mm×6.3 mm.

Preferably, the guide lug biases the contact arm outwardly. The contact arm therefore offers the plug-in contact a reduced opposing force on introduction of the plug-in contact into the socket section, reducing the insertion force to be applied when the plug-in contact and terminal element are brought together.

According to a further embodiment, the guide lug protrudes from an outer wall of the additional spring, from which the additional spring arm also protrudes. In this case the guide lug can protrude from a central region of the outer wall of the additional spring, while the additional spring arm protrudes from edge regions of the outer wall of the additional spring, i.e. the guide lug is arranged between the connecting sections of the additional spring arm.

Preferably, the additional spring comprises at least one outwardly extending primary latch spring, which is arranged in particular in a recess in an outer wall of the additional spring. The primary latch spring serves to secure and latch the terminal element in a housing. With respect to manufacture, therefore, rapid construction of an array of several terminal elements is possible by inserting and latching the terminal elements in the housing. The primary latch spring is protected in the recess in the outer wall of the additional spring, so that damage to the primary latch spring can be prevented.

According to a further embodiment, the base element and the additional spring form separate components, the additional spring being connected to the base element in form-locking relationship. During manufacture, base element and additional spring can therefore be produced separately. The assembly of base element and additional spring is made easier by the form-locking relationship of the components. Moreover, the base element can be made of a material which is electrically particularly conductive, and the additional spring can be made of a material with particularly high mechanical elasticity.

Preferably, the base element and/or the additional spring are/is designed as a stamped and bent part. The electrical terminal element according to the invention is therefore easy and also inexpensive to manufacture.

FIG. 1 illustrates a non-limiting example of an electrical terminal element 10 having a socket section 12 and a terminal section 14. By crimping in the region of the terminal section 14, the terminal element 10 can be connected to an electrical cable (not shown).

The terminal element 10 has a base element 15 which is formed in one piece from a wrought copper alloy in the form of a stamped and bent part. In the region of the socket section 12, the base element 15 has two contact arms 28.

In the region of socket section 12, the base element 15 is further surrounded by an additional spring 16 which is substantially cuboid. The additional spring 16 is made in one piece from spring steel by a stamping and bending process.

To fix the terminal element 10 in a housing (not shown) the additional spring 16 has on each of opposed outer walls 17 a primary latch spring 18 which protrudes outwardly from a recess 22 in the outer wall 17 of the additional spring 16. The primary latch springs 18 in a front region of the additional spring 16 in each case merge with a guide lug 24, which lugs are bent round into the additional spring 16 and define an insertion opening 26 for a plug-in contact to be introduced into the socket section 12.

Figure 2:
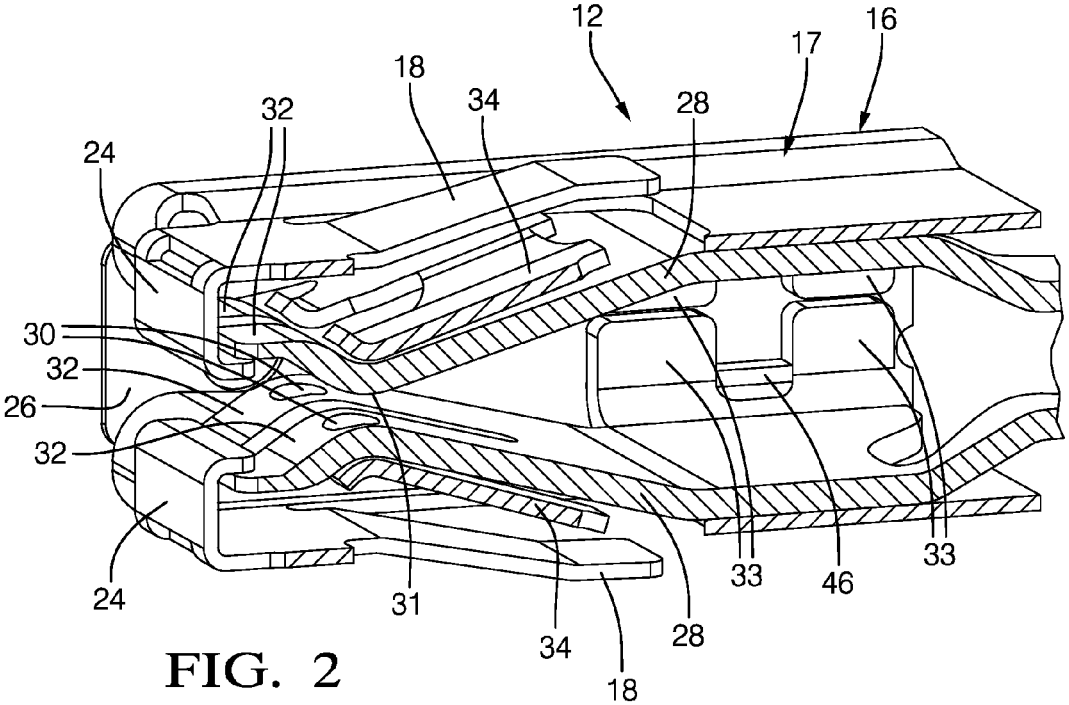
FIG. 2 is an illustration of a vertical longitudinal section through the electrical terminal element in the region of a socket section in accordance with one embodiment.

The inwardly bent guide lugs 24 cooperate, as shown in FIG. 2, on the inside with end regions of the contact arms 28, and bias the contact arms 28 outwardly, i.e. spread them apart slightly, forming between contact surfaces 30 of the contact arms 28 a contact gap 31 which reduces the force required to introduce the plug-in contact.

Starting from the contact surfaces 30, the contact arms 28 diverge rearwardly until they abut against opposed inner surfaces of the additional spring 16. In this region the contact arms 28 comprise on each side two spacers 33 which protrude laterally from the contact arms 28 and are bent round substantially at right angles, so that the spacers 33 of one contact arm 28 are seated on the spacers 33 of the other contact arm 28. Each pair of spacers 33 defines between them a locking opening 20. Side lugs 46 of the additional spring 16 engage in the locking openings 20 and so fix the additional spring 16 to the base element 15 in a form-locking manner.

Figure 3:
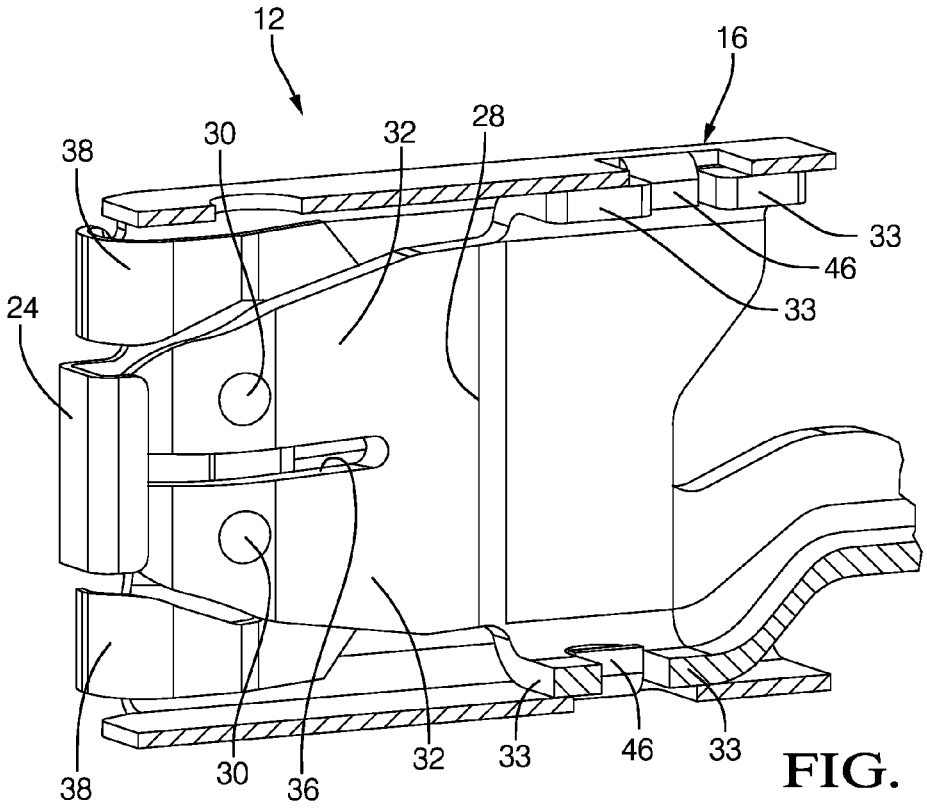
FIG. 3 is an illustration of a horizontal longitudinal section through the socket section of the electrical terminal element according to the invention, which shows a contact arm in accordance with one embodiment.

The contact arms 28 are divided in a front region into two partial contacts 32 each. Specifically, the partial contacts 32 of each contact arm 28 are separated from each other by a gap 36 (see FIG. 3), producing a certain capacity of the partial contacts 32 for movement independently of each other. Each partial contact 32 has, in a region facing towards the insertion opening 26, a contact surface 30 with which it is in contact with the inserted plug-in contact. The plug-in contact is therefore connected at a total of four contact surfaces 30 to the four partial contacts 32.

In the region of the contact surfaces 30, each contact arm 28 cooperates with an additional spring arm 34 of the additional spring 16. Each additional spring arm 34 has two connecting sections 38 which in the region of the insertion opening 26 protrude from edge regions of the outer wall 27 of the additional spring 16 and are bent inwardly. The connecting sections 38 taper inwardly and merge with support sections 40 which are plate-shaped. The support sections 40 are connected to each other by a waisted web 42, producing a certain capacity of the support sections 40 for movement towards each other.

Figure 4:
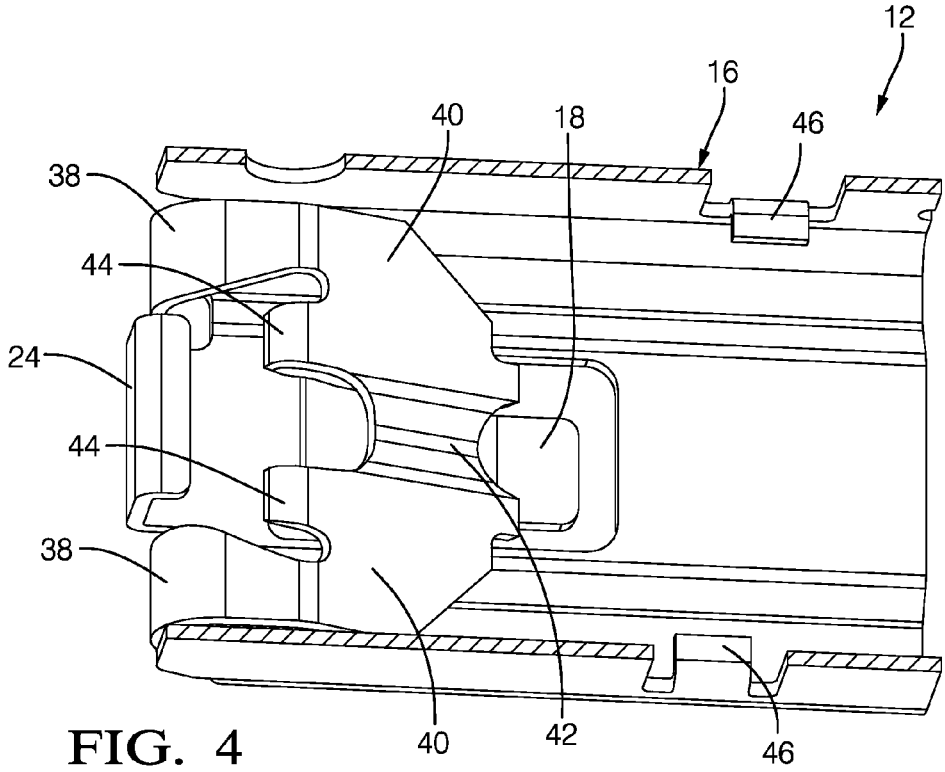
FIG. 4 is an illustration of an alternate horizontal section through the socket section of the electrical terminal element which shows an additional spring arm in accordance with one embodiment.

From the support sections 40 protrude, in a forward direction, support tongues 44 which abut against the partial contacts 32 and support them resiliently, in order to increase the spring strength of the partial contacts 32 and hence of the contact arms 28 as a whole (see FIGS. 2 and 4). Specifically, each partial contact 32 is assigned a support tongue 44 which in the region of the contact surface 30 cooperates with the respective partial contact 32 or, to be more precise, forces the latter in the direction of the contact gap 31.

If a plug-in contact is introduced into the insertion opening 26, it forces the partial contacts 32 outwardly. The partial contacts 32 hence in turn deflect the support tongues 44 and therefore the additional spring arms 34, resulting in a return force which is exerted by the partial contacts 32 and the support tongues 44 on the plug-in contact and which ensures reliable contacting of the plug-in contact in the terminal element 10.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

LISTING OF REFERENCE NUMBERS

10 electrical terminal element
12 socket section
14 terminal section
15 base element
16 additional spring
17 outer wall
18 primary latch spring
20 locking opening
22 recess
24 guide lug
26 insertion opening
28 contact arm
30 contact surface
31 contact gap

32 partial contact
33 spacer
34 additional spring arm
36 gap
38 connecting section
40 support section
42 web
44 support tongue
46 side lug

We claim:

1. An electrical terminal element, comprising:

a base element with at least one terminal section and at least one socket section which has at least one contact arm for contacting a plug-in contact which can be introduced into the at least one socket section, wherein the at least one contact arm is divided into at least two partial contacts in a contact region in which contacting of the inserted plug-in contact takes place; and an additional spring which surrounds the base element in a region of the at least one socket section and which has at least one additional spring arm which cooperates with the at least one contact arm at least in the contact region, so that the latter can be deflected against a return force of the at least one additional spring arm, wherein the at least one additional spring arm is bent inwardly in a region of an insertion opening for the plug-in contact, wherein the at least one additional spring arm comprises at least two support tongues which each cooperate with one of the at least two partial contacts, wherein the at least two support tongues extend in a direction of the insertion opening for the plug-in contact, wherein the at least two support tongues protrude from support sections of the at least one additional spring arm, and wherein the support sections are connected to each other by a web which is tapered relative to the support sections.

2. The electrical terminal element according to claim 1, wherein the support sections are connected by a connecting section to an outer wall of the additional spring.

3. The electrical terminal element according to claim 2, wherein the base element has two mutually opposed contact arms and the additional spring has two additional spring arms which each cooperate with at least one contact arm.

4. The electrical terminal element according to claim 3, wherein the additional spring has at least one inwardly bent guide lug which on the inside overlaps an end region of at least one contact arm in the region of the insertion opening for the plug-in contact.

5. The electrical terminal element according to claim 4, wherein the guide lug biases the at least one contact arm outwardly.

6. The electrical terminal element according to claim 5, wherein the guide lug protrudes from the outer wall of the additional spring, from which the at least one additional spring arm also protrudes.

7. The electrical terminal element according to claim 6, the additional spring comprises at least one outwardly extending primary latch spring, which is arranged in a recess in the outer wall of the additional spring.

8. The electrical terminal element according to claim 7, wherein the base element and the additional spring form separate components, the additional spring being connected to the base element in form-locking relationship.

9. The electrical terminal element according to claim 8, wherein the base element is designed as a stamped and bent part.

10. The electrical terminal element according to claim 9, wherein the additional spring is designed as a stamped and bent part and is substantially cuboid.

11. The electrical terminal element according to claim 8, wherein the additional spring is designed as a stamped and bent part and is substantially cuboid.

* * * * *